US009222443B2

(12) United States Patent
Peters et al.

(10) Patent No.: US 9,222,443 B2
(45) Date of Patent: Dec. 29, 2015

(54) METHOD FOR PURGING FUEL VAPORS TO AN ENGINE

(75) Inventors: Mark W. Peters, Wolverine Lake, MI (US); Kenneth L. Pifher, Holly, MI (US); Kenneth James Miller, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 891 days.

(21) Appl. No.: 13/444,755

(22) Filed: Apr. 11, 2012

(65) Prior Publication Data

US 2013/0269660 A1 Oct. 17, 2013

(51) Int. Cl.

| | |
|---|---|
| ***F02M 33/02*** | (2006.01) |
| ***F02M 33/04*** | (2006.01) |
| ***F02M 25/08*** | (2006.01) |
| ***F02D 41/00*** | (2006.01) |

(52) U.S. Cl.

CPC ..... *F02M 25/08* (2013.01); *F02D 41/0032* (2013.01); *F02D 41/0045* (2013.01); *F02D 2041/001* (2013.01); *F02D 2250/41* (2013.01)

(58) Field of Classification Search

CPC ..... F02M 25/0836; F02M 25/0854; F02M 25/08; F02M 25/089; F02M 25/0809; F02M 25/0818; F02M 25/0872; F02D 41/0032; F02D 41/004; F02D 41/0045; F02D 2200/0406; F02D 41/003

USPC ..... 123/518, 519, 520, 521

See application file for complete search history.

(56) References Cited

U.S. PATENT DOCUMENTS

| | | | | | |
|---|---|---|---|---|---|
| 4,116,184 | A * | 9/1978 | Tomita | | 123/438 |
| 5,080,078 | A * | 1/1992 | Hamburg | | 123/521 |
| 5,273,020 | A * | 12/1993 | Hayami | | 123/520 |
| 5,497,757 | A * | 3/1996 | Osanai | | 123/674 |
| 5,893,354 | A | 4/1999 | Detweiler et al. | | |
| 5,967,125 | A * | 10/1999 | Morikawa | F02D | 13/0234 123/520 |
| 5,967,487 | A | 10/1999 | Cook et al. | | |
| 6,082,338 | A * | 7/2000 | Izutani | F02D | 13/0234 123/520 |
| 6,390,063 | B1 * | 5/2002 | Obata et al. | | 123/399 |
| 6,513,493 | B1 * | 2/2003 | Robichaux et al. | | 123/399 |
| 6,557,534 | B2 | 5/2003 | Robichaux et al. | | |
| 2001/0029933 | A1 * | 10/2001 | Fabre | | 123/520 |
| 2010/0300413 | A1 * | 12/2010 | Ulrey et al. | | 123/518 |
| 2011/0146631 | A1 | 6/2011 | Konohara et al. | | |
| 2012/0016566 | A1 | 1/2012 | Cunningham et al. | | |

* cited by examiner

*Primary Examiner* — Hai Huynh
*Assistant Examiner* — Raza Najmuddin
(74) *Attorney, Agent, or Firm* — Julia Voutyras; Alleman Hall McCoy Russell & Tuttle LLP

(57) ABSTRACT

A method for improving purging of fuel vapors from a fuel vapor storage canister to an engine is presented. In one example, the method adjusts engine operation to provide sonic flow between a canister and the engine. In this way, it may be possible to lower an amount of fuel vapors stored in a canister while the engine continues to operate efficiently.

20 Claims, 4 Drawing Sheets

METHOD FOR PURGING FUEL VAPORS TO AN ENGINE

FIELD

The present description relates to a method for improving the purging of fuel vapors from a fuel vapor canister. The method may be particularly useful for purging fuel vapors to engines that operate at a high volumetric efficiency.

BACKGROUND AND SUMMARY

Engine pumping work may be reduced to increase engine efficiency by operating an engine at higher intake manifold pressures. However, at least for spark ignited engines, it is desirable to regulate the amount of air entering the engine so that the engine air-fuel ratio will not be leaner than is desired, or so that the engine may not produce more than a desired amount of torque. Higher intake manifold pressures can be achieved while regulating the amount of air entering the engine by closing intake valves late. Closing the intake valves late allows air that enters cylinders to be pushed back into the intake manifold during the compression stroke. In this way, intake manifold pressure is increased while cylinder air charge is regulated to less than full load cylinder air charge.

Operating the engine at higher intake manifold pressures provides challenges that were not foreseen when engines where operated with high levels of vacuum in the engine intake manifold. One challenge is to provide sufficient flow from a canister storing fuel vapors to the engine when the engine intake manifold is at a relatively high pressure. If flow from the fuel vapor storage canister to intake manifold is too low, fuel vapors may spill from the canister to ambient air.

The inventors herein have recognized the above-mentioned disadvantages and have developed a method for purging fuel vapors, comprising: supplying fuel vapors to an engine via a storage canister and a purge valve; and adjusting an engine valve timing up to and not exceeding a timing where a sonic flow occurs between the storage canister and the engine in response to a concentration of hydrocarbons flowing from the storage canister to the engine.

By adjusting engine operation to provide sonic flow between the canister and the engine while at the same time limiting valve timing to not exceed a timing that provides sonic flow between the canister and the engine, it may be possible to operate the engine efficiently even when purging fuel vapors from the canister to the engine. For example, intake valve timing of an engine operating with late intake valve closing may be retarded to an extent where intake pressure is low enough to provide sonic flow between the canister and the engine, but not where intake manifold pressure is substantially lower than an intake manifold pressure that provides sonic flow between the canister and the intake manifold. In this way, the engine may be operated at a higher engine intake manifold pressure that provides sonic flow between the canister and the engine. Further, in one example, the engine intake manifold pressure that provides sonic flow between the canister and the engine is adjustable to account for changes in barometric pressure. Thus, valve timing can be advanced or retarded as the altitude at which the engine operates changes so that sonic flow between the canister and the engine intake manifold may be provided.

The present description may provide several advantages. In particular, the approach may allow the engine to operate efficiently while providing a high flow rate between a fuel vapor storage canister and the engine. Further, the approach can increase flow of fuel vapors from the canister to the engine when a concentration of fuel vapors stored in the canister is determined to be increasing. Further still, the approach may reduce the possibility of fuel vapors escaping from the canister to atmosphere.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
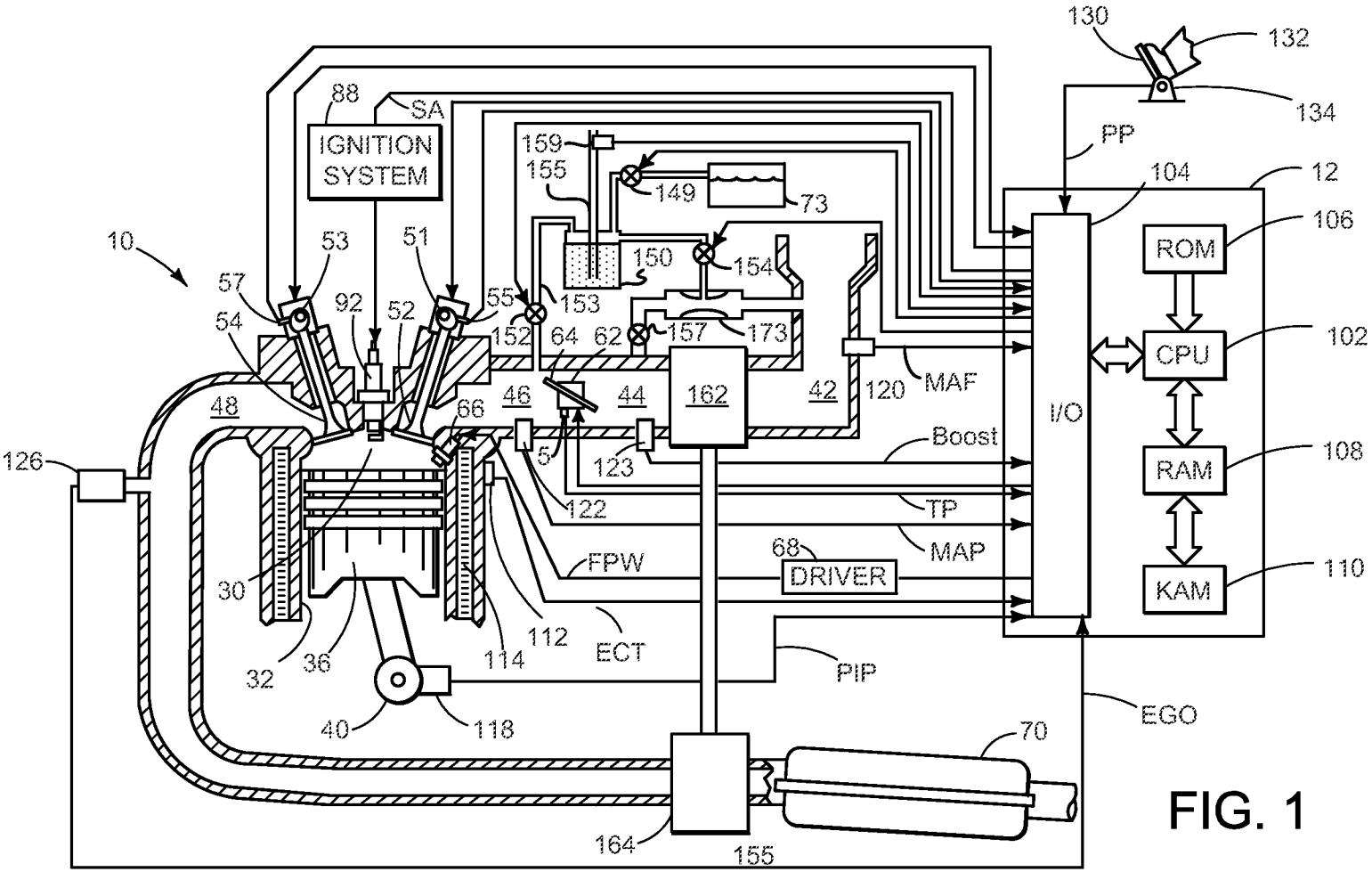
FIG. 1 is a schematic diagram of an engine.
Figure 2:
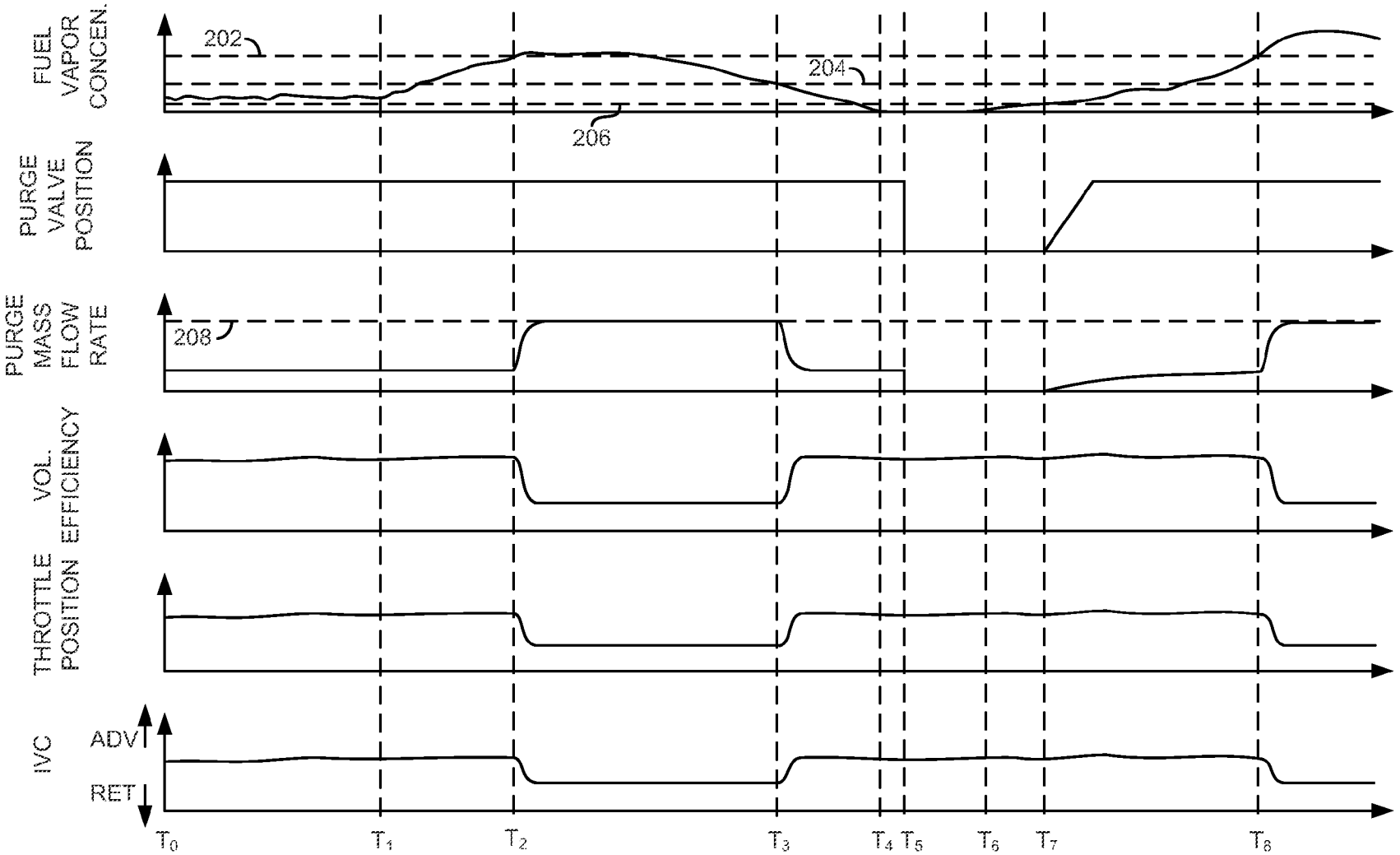
FIGS. 2 and 3 show simulated signals of interest for purging fuel vapors to an engine.
Figure 3:
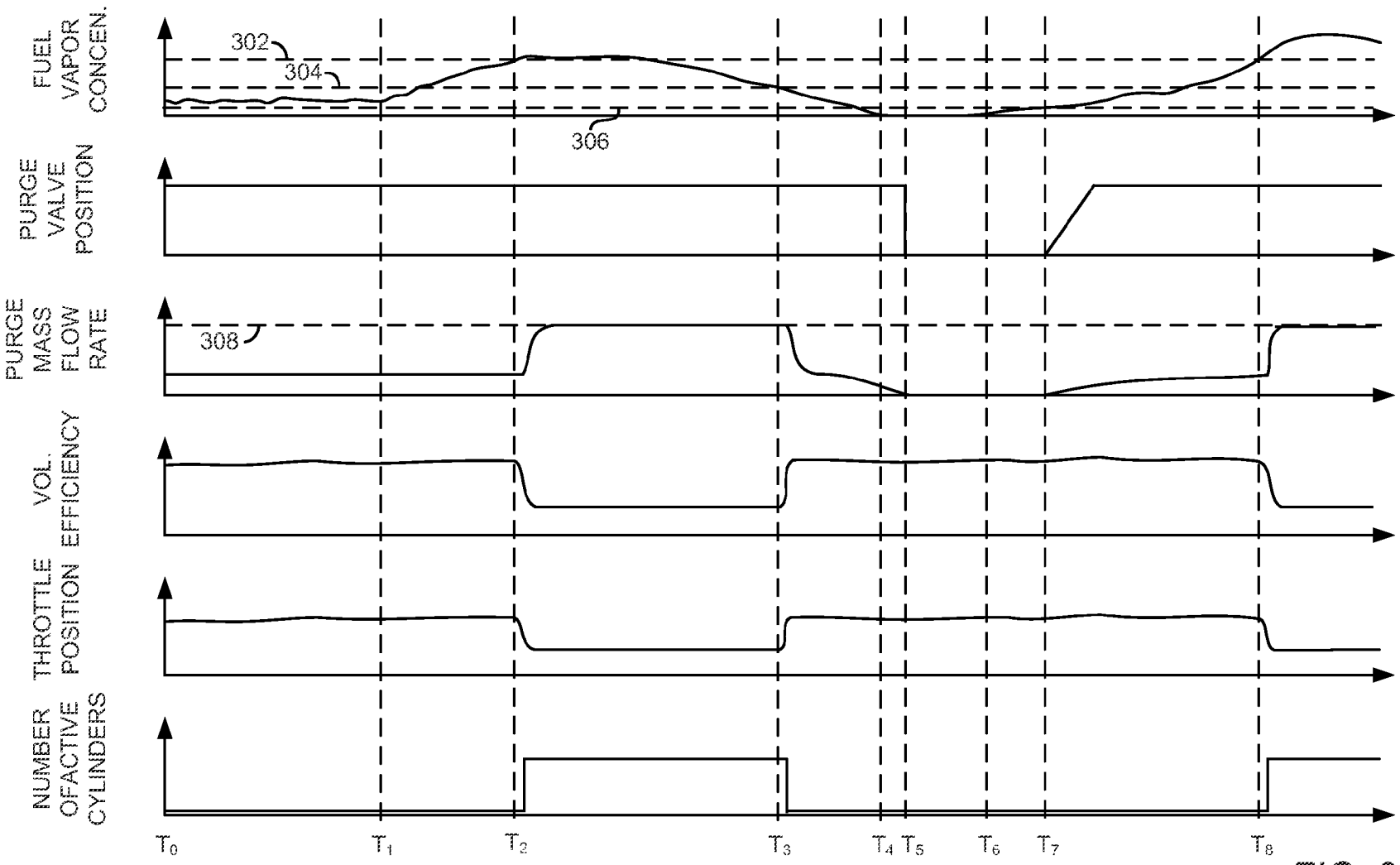
Figure 4:
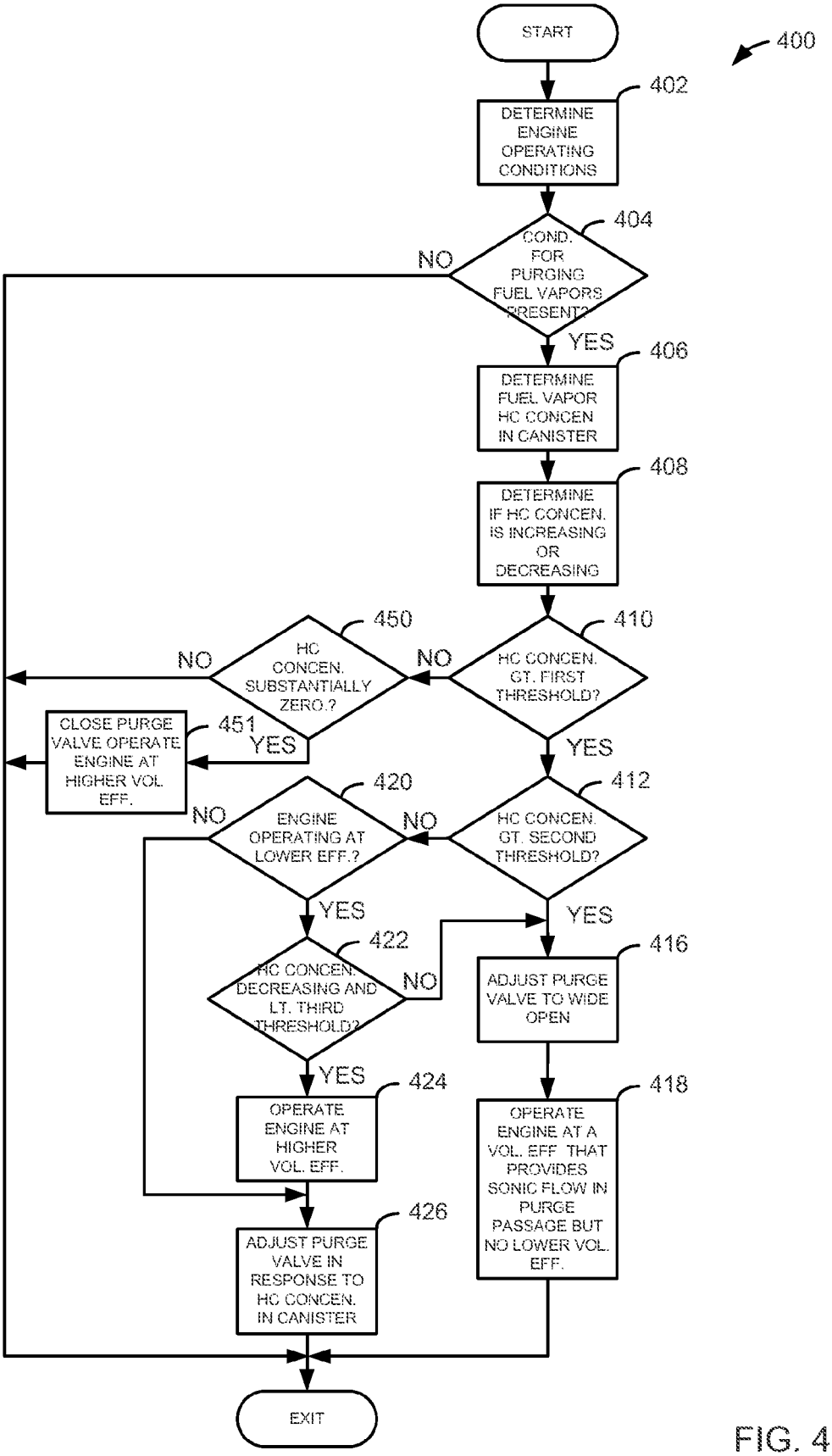
FIG. 4 is an example flowchart of a method for purging fuel vapor that are stored in a canister to an engine.

The present description is related to purging fuel vapors from a fuel vapor storage canister to an engine. In one non-limiting example, the engine may be configured as illustrated in FIG. 1. Operation of an engine may be adjusted as shown in FIGS. 2 and 3 to increase hydrocarbon flow to the engine when a concentration of the hydrocarbons stored in the canister is greater than a threshold level. Increasing the flow rate of hydrocarbons to the engine can decrease the concentration of hydrocarbons stored in the canister so that there may be less possibility of fuel vapors escaping the canister to atmosphere. FIG. 4 shows an example method for operating the engine and system in FIG. 1 according to the sequences shown in FIGS. 2 and 3.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 46 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown)

including a fuel tank, fuel pump, and fuel rail (not shown). Fuel injector 66 is supplied operating current from driver 68 which responds to controller 12. In addition, intake manifold 46 is shown communicating with optional electronic throttle 62 which adjusts a position of throttle plate 64 to control air flow from intake boost chamber 44. Compressor 162 draws air from air intake 42 to supply intake boost chamber 44. Exhaust gases spin turbine 164 which is coupled to compressor 162. In one example, a low pressure direct injection system may be used, where fuel pressure can be raised to approximately 20-30 bar. Alternatively, a high pressure, dual stage, fuel system may be used to generate higher fuel pressures.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of turbocharger compressor 164 and catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Fuel vapor storage canister 150 contains activated carbon or other known media to temporarily store fuel vapors. Fuel vapors may originate from the fuel tank 73, the intake manifold, or other point in the fuel system. Valve 149 controls the flow of fuel vapors from fuel tank 73 to fuel vapor storage canister 150. Canister purge control valve 152 controls flow of fuel vapors from fuel vapor storage canister 150 to intake manifold 46. Air velocity in passage 153 may be sonic when a pressure ratio (e.g., $P_2/P_1$ where $P_1$ is the pressure upstream of an orifice and $P_2$ is a pressure downstream of the orifice) across valve 152 or passage 153 is less than 0.528. Further, since passage 153 is supplied fixed density ambient air though passage 155, mass flow through valve 152 and passage 153 becomes choked or sonic at pressure ratios less than 0.528. Therefore, pressure ratios across valve 152 and passage 153 are limited to greater than 0.528 since lower pressure ratios provide no higher flow rates. Fresh air may be drawn into fuel vapor storage canister 150 via vent passage 155. In some examples, a valve may be positioned along vent passage 155 to control the flow of fresh air into fuel vapor storage canister 150. Hydrocarbon sensor 159 provides an indication of an amount of hydrocarbons stored in fuel vapor storage canister 150.

Fuel vapor storage canister 150 can also purge fuel vapors to air intake 42 via venturi 173. When compressor 162 produces a positive pressure in boost chamber 44, venturi control valve 157 can be partially or fully opened or modulated to allow air to flow from boost chamber 44 through venturi 173 and into air intake 42. A pressure drop occurs in venturi 173 creating a low pressure region when air flows through venturi 173 from compressor 162. Lower pressure at venturi 173 induces flow from fuel vapor storage canister 150 to venturi 173 when canister venturi control valve 154 is at least partially open. The pressure drop at venturi 173 is related to the venturi design and the velocity of air flow through the venturi. In one example, valves 154 and 157 are set to an open state when flow from the fuel vapor storage canister 150 to the air intake 42 is desired. A pressure ratio of less than 0.528 across venturi 173 or valve 157 can provide sonic velocity of air through venturi 173 and valve 62. In one example, the pressure ratio across venturi 173 and valve 157 is limited to greater than 0.528 because lower pressure ratios may provide smaller increases in mass flow rate as the density in boost chamber 44 is increased.

Canister vacuum control valve 152 can be opened so that there is flow from fuel vapor storage canister 150 to intake manifold 46 and air intake 42 while there is or is not flow from fuel vapor storage canister 150 to venturi 173. For example, when intake manifold pressure is slightly below atmospheric pressure, a small amount of flow to the intake manifold 46 may be generated. At the same time, venturi 173 may draw flow from fuel vapor storage canister 150.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold absolute pressure (MAP) from pressure sensor 122 coupled to intake manifold 46; a measurement of boost pressure from pressure sensor 123; a measurement of air mass entering the engine from sensor 120; and a measurement of throttle position from a sensor 5. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 46, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 shows simulated signals of interest for purging stored fuel vapors from a fuel vapor storage canister to an engine. The simulated signals of FIGS. 2-3 are representative for a system as shown in FIG. 1 and the methods described in FIG. 4. Vertical markers $T_0$-$T_8$ identify times of particular interest during the sequence. The sequence described occurs at constant engine speed and load operating conditions.

The first plot from the top of FIG. 2 represents a hydrocarbon concentration stored in a canister versus time. The concentration of hydrocarbons increases in the direction of the Y axis arrow. The X axis represents time and time increases from the left side of the figure to the right side of the figure. Horizontal marker 202 represents a hydrocarbon concentration where sonic velocity and sonic flow is induced from the canister to the engine so as to increase evacuation of hydrocarbons from the canister to the engine. Horizontal marker 204 represents a level of hydrocarbon concentration where fuel vapor purging is reduced from a sonic level by lowering the velocity and/or flow of gas from fuel vapor storage canister 150 or FIG. 1 to intake manifold 46. Horizontal marker 206 represents a level of hydrocarbon concentration where fuel vapor purging begins after being stopped.

The second plot from the top of FIG. 2 represents a canister purge valve position (e.g., 152 of FIG. 1) versus time. The canister purge valve opening amount increases in the direction of the Y-axis arrow. The X axis represents time and time increases from the left side of the figure to the right side of the figure.

The third plot from the top of FIG. 2 represents canister purge mass flow rate (e.g., a mass flow rate from fuel vapor storage canister 150 to intake manifold 46 shown in FIG. 1) versus time. The canister purge mass flow rate increases in the direction of the Y axis arrow. The X axis represents time and time increases from the left side of the figure to the right side of the figure. Horizontal marker 208 represents sonic or choked velocity and/or flow from the fuel vapor canister to the engine.

The fourth plot from the top of FIG. 2 represents engine volumetric efficiency versus time. Engine volumetric efficiency increases in the direction of the Y-axis arrow. The X axis represents time and time increases from the left side of the figure to the right side of the figure.

The fifth plot from the top of FIG. 2 represents engine air inlet throttle position. The air inlet throttle opening amount increases in the direction of the Y-axis arrow. The X axis represents time and time increases from the left side of the figure to the right side of the figure.

The sixth plot from the top of FIG. 2 represents intake valve closing (IVC) timing. In this example, IVC is late when higher intake manifold pressures and low engine air flow are desired to increase engine efficiency via reducing engine pumping work. IVC is advanced in the direction of the advance arrow. IVC is retarded in the direction of the retard arrow. IVC approaches bottom-dead-center intake stroke when IVC is retarded. The X axis represents time and time increases from the left side of the figure to the right side of the figure.

At time $T_0$, the fuel vapor or hydrocarbon concentration is at a lower level and the canister purge valve is in a fully open position. Opening the canister purge valve to a fully open position may increase mass flow of fuel vapors from the fuel vapor storage canister to the engine intake manifold. The purge mass flow rate is at a relatively low flow rate even though the canister purge valve is in a fully open position. A low mass flow rate is indicative of a small pressure drop from the canister to the engine intake manifold. The engine is operating at a higher volumetric efficiency level. In this example, the higher volumetric efficiency is provided by advancing the IVC location away from bottom-dead-center intake stroke. Advancing IVC increases an amount of air pushed back from the cylinder to the intake manifold and limits air flow into the engine. The throttle position is also at a higher level to provide a desired air flow rate into the engine while the engine intake manifold pressure is relatively high.

At time $T_1$, the hydrocarbon concentration in the fuel vapor storage canister begins to increase. The concentration of hydrocarbons stored in the canister may increase when a temperature of a fuel tank increases or when the fuel tank is agitated. The hydrocarbon concentration continues to increase between time $T_1$ and time $T_2$. The canister purge valve state, purge mass flow rate, engine volumetric efficiency, throttle position, and IVC timing remain substantially constant.

At time $T_2$, the hydrocarbon concentration reaches a level where it is desirable to increase the mass flow rate of hydrocarbons from the canister to the engine to thereby reduce the amount of hydrocarbons stored in the fuel vapor storage canister. The engine volumetric efficiency is reduced by partially closing the throttle and retarding IVC. Further, pressure in the intake manifold is reduced to a level that creates a pressure ratio of substantially 0.528 across the canister purge valve or between the canister and the intake manifold after threshold level 202 is reached. Lower pressure ratios are not provided since decreasing the pressure ratio further may provide little if any increase in mass flow from the fuel vapor storage canister to the engine. Further, lower pressure ratios can decrease engine efficiency and increase engine pumping work. Consequently, the engine volumetric efficiency is decreased only by an amount that provides sonic velocity and/or mass flow between the fuel vapor storage canister and the engine intake manifold.

Between time $T_2$ and time $T_3$, the hydrocarbon concentration in the fuel vapor storage canister is reduced as the mass flow rate from the fuel vapor storage canister to the engine intake manifold is increased. The canister purge mass flow rate is limited to sonic velocity and/or sonic mass flow. The engine volumetric efficiency, throttle position, and IVC remain substantially unchanged.

At time $T_3$, the hydrocarbon concentration in the fuel vapor storage canister has decreased to a level less than the threshold level indicated by horizontal marker 204. The canister purge mass flow rate is reduced in response to the fuel vapor storage canister hydrocarbon concentration. The canister purge mass flow rate is reduced by increasing the engine volumetric efficiency via advancing IVC and opening the throttle. Thus, the intake manifold pressure is raised to increase the pressure ratio between the fuel vapor storage canister and the engine intake manifold. The canister purge valve remains in a wide open position after the engine volumetric efficiency is increased.

At time $T_4$, the hydrocarbon concentration in the fuel vapor storage canister has decreased substantially to zero. The hydrocarbon concentration may go toward zero when air passing through the fuel vapor storage canister has stripped off most hydrocarbons from the storage medium. The canister purge valve stays open for a short time longer and then closes at time $T_5$. The canister purge mass flow rate goes to zero when the canister purge valve is closed.

Between time $T_5$ and time $T_6$, the amount of hydrocarbons stored in the fuel vapor storage canister remains low. Consequently, the engine continues to operate at a high volumetric efficiency where IVC is advanced and the air inlet throttle is more open. The engine fuel consumption may be reduced via operating the engine this way when requested engine torque is relatively low.

At time $T_6$, the amount of hydrocarbons stored in the fuel vapor storage canister increases to a noticeable level and continues to rise until it reaches a threshold level 206 at time $T_7$. The canister purge valve is opened when the amount of hydrocarbons reaches the level of 206. In one example, the canister purge valve opening amount is based on the amount of hydrocarbons detected within the fuel vapor storage canister. The canister purge valve is ramped open to allow additional flow between the fuel vapor storage canister and the intake manifold. The canister purge valve reaches full open position shortly after time $T_7$. The engine continues to operate at a higher volumetric efficiency with IVC advanced and the throttle wider open while hydrocarbons stored in the fuel vapor storage canister are less than threshold amount 202.

At time $T_8$, the amount of hydrocarbons stored in the fuel vapor storage canister increases to an amount indicated by horizontal marker 202. At this hydrocarbon level, the engine volumetric efficiency is reduced by retarding IVC and closing the air inlet throttle. The engine volumetric efficiency is reduced only to a level where air flows from the fuel vapor storage canister to the engine intake manifold at a sonic velocity and/or mass flow rate depending on the origin of the air entering the fuel vapor storage canister. In this way, the engine may be operated efficiently while purging a higher flow rate of hydrocarbon vapors. The engine continues to operate at the lower volumetric efficiency while the hydrocarbon vapors stored in the fuel vapor storage canister are above the threshold level 204.

Referring now to FIG. 3, an alternative way to purge stored fuel vapors from a fuel vapor storage canister to an engine is shown. The plots and variables shown in FIG. 3 are similar to those shown in FIG. 2 except where described otherwise. Therefore, for the sake of brevity, only differences between the sequences are described.

The sixth plot from the top of FIG. 3 represents a number of cylinders operating in an engine versus time. The number of active cylinders combusting an air-fuel mixture during a cycle of the engine is less than the total number of engine cylinders when the number of cylinders trace is at a lower level near the X axis. The number of active cylinders combusting an air-fuel mixture during a cycle of the engine is greater when the number of cylinders trace it at a higher level than when the number of cylinders trace is at a lower level. For example, for an eight cylinder engine, eight cylinders are combusting an air-fuel mixture when the number of cylinders trace is at a higher level. Conversely, four cylinders are combusting an air-fuel mixture when the number of cylinders trance is at a lower level.

At time $T_0$, the fuel vapor or hydrocarbon concentration is at a lower level and the canister purge valve is in a fully open position. The purge flow rate is at a relatively low flow rate even though the canister purge valve is in a fully open position. The engine is operating at a higher volumetric efficiency level. In this example, the higher volumetric efficiency is provided by operating less than the total number of cylinders (e.g., combusting an air-fuel mixture in four of eight engine cylinders). The engine air inlet throttle is more fully open when the engine provides a level of torque using fewer cylinders as compared to when a total number of engine cylinders are used to provide the same level of torque. In this way, a greater cylinder air charge is delivered to active engine cylinders when the engine is operating with less than a full complement of engine cylinders. The active engine cylinders operate with a higher volumetric efficiency at the higher air charge since less intake vacuum is needed to operate the engine and provide a desired amount of torque. Intake manifold pressure is relatively high since the throttle is more open to provide air to operate the four active cylinders. Consequently, the pressure ratio between the engine intake manifold and the fuel vapor canister is greater than 0.528 and the mass flow rate is relatively low.

At time $T_1$, the hydrocarbon concentration in the fuel vapor storage canister begins to increase. The hydrocarbon concentration continues to increase between time $T_1$ and time $T_2$. The canister purge valve state, purge mass flow rate, engine volumetric efficiency, throttle position, and number of active cylinders remain substantially constant.

At time $T_2$, the hydrocarbon concentration reaches a level where it is desirable to increase the flow rate of hydrocarbons from the canister to the engine. The engine volumetric efficiency is reduced by increasing the number of active cylinders and partially closing the air inlet throttle shortly after threshold 302 is reached. Further, pressure in the intake manifold is reduced to a level that creates a pressure ratio of substantially 0.528 across the canister purge valve or between the canister and the intake manifold. Lower pressure ratios are not provided since decreasing the pressure ratio further may provide little if any increase in mass flow from the fuel vapor storage canister to the engine. Engine volumetric efficiency is decreased only by an amount that provides sonic velocity and/or mass flow between the fuel vapor storage canister and the engine intake manifold.

Between time $T_2$ and time $T_3$, the hydrocarbon concentration in the fuel vapor storage canister is reduced as the flow rate from the fuel vapor storage canister to the engine intake manifold is increased. The canister purge flow rate is limited to sonic velocity and/or sonic mass flow. The engine volumetric efficiency, throttle position, and number of active cylinders remain substantially unchanged.

At time $T_3$, the hydrocarbon concentration in the fuel vapor storage canister has decreased to a level less than the threshold level indicated by horizontal marker 304. The canister purge flow rate is reduced by decreasing the number of active cylinders and opening the air inlet throttle shortly thereafter. The number of active cylinders is adjusted in response to the fuel vapor storage canister hydrocarbon concentration. In this way, the intake manifold pressure is raised to increase the pressure ratio between the fuel vapor storage canister and the engine intake manifold. The canister purge valve remains in a wide open position after the engine volumetric efficiency is increased.

At time $T_4$, the hydrocarbon concentration in the fuel vapor storage canister has decreased substantially to zero. The canister purge valve stays open for a short time longer and then closes at time $T_5$. The canister purge flow rate goes to zero when the canister purge valve is closed.

Between time $T_5$ and time $T_6$, the amount of hydrocarbons stored in the fuel vapor storage canister remains low. Therefore, the engine continues to operate at a higher volumetric efficiency where the number of active engine cylinder is less than the total number of engine cylinders. The engine fuel consumption may be reduced via operating the engine this way when requested engine torque is relatively low.

At time $T_6$, the amount of hydrocarbons stored in the fuel vapor storage canister increases to a noticeable level and continues to rise until it reaches a threshold level 306 at time $T_7$. The canister purge valve is opened when the amount of hydrocarbons reaches the level of 306. The canister purge valve is ramped open to allow additional flow between the fuel vapor storage canister and the intake manifold. The canister purge valve reaches full open position shortly after time $T_7$. The engine continues to operate at a higher volumetric efficiency with fewer active cylinders than a total number of cylinders. The throttle also operates at a wider open position while hydrocarbons stored in the fuel vapor storage canister are less than threshold amount 302.

At time $T_8$, the amount of hydrocarbons stored in the fuel vapor storage canister increases to an amount indicated by horizontal marker 302. At this level, the engine volumetric efficiency is reduced by reactivating inactive cylinders and partially closing the air inlet throttle. Again, the engine volumetric efficiency is reduced only to a level where air flows from the fuel vapor storage canister to the engine intake manifold at a sonic velocity and/or mass flow rate depending on the origin of the air entering the fuel vapor storage canister. Thus, the engine may be operated efficiently while purging a higher flow rate of hydrocarbon vapors. The engine continues to operate at the lower volumetric efficiency while the hydrocarbon vapors stored in the fuel vapor storage canister are above the threshold level 304.

Referring now to FIG. 4, a flowchart of a method for purging fuel vapors that are stored in a fuel vapor storage canister is shown. The method of FIG. 4 may be stored as executable instructions in non-transitory memory in the system illustrated in FIG. 1. The method of FIG. 4 may provide the sequences shown in FIGS. 2 and 3.

At 402, method 400 determines engine operating conditions. Engine operating conditions may include but are not limited to engine speed, engine load, amount of hydrocarbons stored in a fuel vapor storage canister, throttle position, IVC timing, number of active cylinders, and canister purge valve position. Method 400 proceeds to 404 after engine operating conditions are determined.

At 404, method 400 judges whether or not conditions for purging fuel vapors from a fuel vapor storage canister are present. In one example, fuel vapors may be purged from a fuel vapor storage canister to an engine after the engine has been operating for a predetermined amount of time since start and/or after the engine has reached a predetermined operating temperature. Of course, additional or fewer conditions may be a basis for purging fuel vapors. If method 400 judges that conditions are present for purging fuel vapors, the answer is yes and method 400 proceeds to 406. Otherwise, the answer is no and method 400 proceeds to exit.

At 406, method 400 determines a hydrocarbon (HC) concentration of fuel vapors stored in a fuel vapor storage canister. The higher the concentration of hydrocarbons, the more hydrocarbons are stored in the fuel vapor storage canister. In one example, the hydrocarbon concentration may be determined via a hydrocarbon sensor. In another example, the amount of hydrocarbons may be determined via a temperature increase within the fuel vapor storage canister. Method 400 proceeds to 408 after the concentration of hydrocarbons stored in the fuel vapor storage canister is determined.

At 408, method 400 determines if a hydrocarbon concentration in the fuel vapor storage canister is increasing or decreasing. In one example, a concentration of hydrocarbons is determined at predetermined time intervals (e.g., every minute). A concentration of hydrocarbons sampled at an earlier time is subtracted from a concentration of hydrocarbons sampled at the present time. If the result is negative, it is determined that the hydrocarbon concentration is decreasing. If the result is positive, it is determined that the hydrocarbon concentration is increasing. Method 400 proceeds to 410 after it is determined whether the hydrocarbons stored in the fuel vapor canister are increasing or decreasing.

At 410, method 400 judges whether or not the hydrocarbon concentration in the fuel vapor storage canister is greater than a first threshold (e.g., 206 of FIG. 2). The first threshold may vary with operating conditions. For example, the first threshold may decrease as ambient temperature increases so that fuel vapors may be purged earlier in time. If method 400 judges that the amount of hydrocarbons stored in the fuel vapor storage canister is greater than the first threshold, the answer is yes and method 400 proceeds to 412. Otherwise, the answer is no and method 400 proceeds to 450.

At 450, method 400 judges whether or not the amount of hydrocarbons stored in the fuel vapor storage canister is substantially zero. If so, the answer is yes and method 400 proceeds to 451. Otherwise, the answer is no and method 400 proceeds to exit.

At 451, method 400 closes the canister purge valve and operates the engine at a higher volumetric efficiency. In one example, the engine is operated at a higher volumetric efficiency by deactivating (e.g., ceasing combustion in inactive cylinders and closing cylinder valves) a partial number of engine cylinders (e.g., deactivating 4 of 8 cylinders) and increasing an inlet throttle opening amount. In another example, the engine is operated at a higher volumetric efficiency by advancing IVC and increasing an inlet throttle opening amount. In this way, intake manifold pressure may be increased to reduce engine pumping work and reduce engine fuel consumption. Method 400 proceeds to exit after the canister purge valve is closed and the engine is transitioned to a higher volumetric efficiency.

In another example, operation of a device other than engine valve timing or number of active cylinders may be adjusted to provide sonic velocity and/or mass flow from the fuel vapor storage canister to the engine intake manifold. For example, a pump or flow through a venturi as shown in FIG. 1 may be adjusted to provide sonic velocity and/or mass flow of gases between the fuel vapor storage canister and the engine intake manifold. The operation of the device may be adjusted to suspend or stop flow from the fuel vapor storage canister to the engine intake manifold at 451. In one example, a venturi control valve is closed to stop flow between the fuel vapor storage canister and the intake manifold.

At 412, method 400 judges whether or not a concentration of hydrocarbons stored in the fuel vapor storage canister is greater than a second threshold (e.g., 202 of FIG. 2), the second threshold greater than the first threshold at 410. If so, the answer is yes and method 400 proceeds to 416. Otherwise, the answer is no and method 400 proceeds to 420.

At 420, method 400 judges whether or not the engine is operating at a lower volumetric efficiency (e.g., operating with all cylinder at a part load condition or operating with advanced IVC timing at part engine load). If so, the answer is yes and method 400 proceeds to 422. Otherwise, the answer is no and method 400 proceeds to 426.

In another example, where operation of a device other than engine valve timing or number of active cylinders is adjusted to control flow between the fuel vapor storage canister and the engine intake manifold, method 400 judges whether or not the device is providing sonic velocity and/or flow rate between the fuel vapor storage canister and the engine intake manifold. If so, the answer is yes and method 400 proceeds to 422. If not, the answer is no and method 400 proceeds to 426.

At 422, method 400 judges whether or not the hydrocarbons stored in the fuel vapor storage canister are decreasing and less than a third threshold (e.g., 204 of FIG. 2). If so, the answer is yes and method 400 proceeds to 424. Otherwise, the answer is no and method 400 proceeds to 416.

At 424, method 400 transitions the engine to operating at a higher volumetric efficiency if it is not already operating at a higher volumetric efficiency. In one example, an engine is transitioned to operating at a higher volumetric efficiency via reducing a number of active cylinders combusting an air-fuel mixture and increasing an air inlet throttle opening amount. Cylinders may be deactivated by closing intake and exhaust valves of a cylinder and stopping fuel flow to the cylinder. In another example, an engine is transitioned to operating at a higher volumetric efficiency via advancing IVC and increasing an air inlet throttle opening amount. Advancing IVC can reduce cylinder air charge while the intake manifold pressure is increased. Thus, an engine may provide a same amount of torque when operated at a higher intake manifold pressure as an engine operating at a lower intake manifold pressure with a more closed air inlet throttle. Method 400 proceeds to 426 after the engine is transitioned to a higher volumetric efficiency.

In examples where operation of a device other than engine valve timing or number of active cylinders is adjusted to control flow between the fuel vapor storage canister and the engine intake manifold, method 400 operate the device so as to provide less than sonic velocity and/or flow rate between the fuel vapor storage canister and the engine intake manifold. In one example, flow through a venturi is reduced to provide less than sonic velocity and/or flow rate between the fuel vapor storage canister and the engine intake manifold.

At 426, method 400 adjusts a position of a canister purge valve in response to a concentration of hydrocarbons stored in a fuel vapor storage canister and a pressure ratio between the fuel vapor storage canister and the engine intake manifold. In one example, the canister purge valve position is adjusted according to an empirically determined table or function that is indexed by hydrocarbon concentration and pressure ratio from the fuel vapor canister to the engine intake manifold. In one example, as the concentration of fuel vapors decreases, the canister purge valve is closed further. As the concentration of fuel vapors increases, the canister purge valve is opened further. Method 400 proceeds to exit after the canister purge valve position is adjusted.

At 416, method 400 adjusts a canister purge valve to a fully open position. In the fully open position, additional flow of hydrocarbons between the fuel vapor storage canister and the engine intake manifold is permitted. Method 400 proceeds to 418 after the purge valve is adjusted to a full open position.

At 418, method 400 operates the engine at a volumetric efficiency that provides sonic velocity and/or mass flow rate between the fuel vapor storage canister and the engine intake manifold. Further, the volumetric efficiency is lowered only to a level where sonic velocity and/or mass flow rate is achieved so that the engine is not operated less efficiently than is desired. For example, if an engine is operating with a volumetric efficiency of 0.9 at a higher volumetric efficiency, the engine volumetric efficiency may be reduced to 0.82 where a sonic velocity and/or flow rate is achieved between the fuel vapor storage canister and the engine intake manifold. The engine volumetric efficiency is not reduced below the 0.82 level so that the engine continues to operate efficiently. It should be mentioned that the sonic velocity and/or flow rate may occur across the canister purge valve or across another portion of the passage between the fuel vapor storage canister and the engine intake manifold.

In one example, the engine may be adjusted to operate at a volumetric efficiency that provides sonic velocity and/or flow between the fuel vapor canister and the engine intake manifold by retarding IVC from an advanced state where the engine operates more efficiently. Further, the air inlet throttle position may be partially closed as IVC is retarded to control engine air flow and intake manifold pressure. For example, if an engine operates with IVC at 80 crankshaft degrees after bottom-dead-center intake stroke, IVC may be retarded to 70 crankshaft degrees after bottom-dead-center intake stroke to reduce engine volumetric efficiency to a level where sonic velocity and/or flow rate is achieved between the fuel vapor storage canister and the engine intake manifold. IVC is not retarded further than the timing where sonic velocity and/or flow rate are provided.

IVC can also be changed as engine speed and requested torque change to provide the requested torque while sonic velocity and/or flow are provided between the engine intake manifold and the fuel vapor storage canister. However, at higher engine torque demands, canister purge may be temporarily suspended. Further, IVC may be adjusted to account for barometric pressure changes. For example, IVC may retard more as the engine operates at higher altitudes.

In another example, the engine is adjusted to operate a volumetric efficiency that provides sonic velocity and/or flow between the fuel vapor canister and the engine intake manifold by deactivating a portion of a total number of engine cylinders. Further, the air inlet throttle position and spark timing are adjusted so that the desired engine torque and volumetric efficiency are provided. For example, if an engine is operating with four of eight cylinders and sonic velocity and/or flow is requested between the fuel vapor storage canister and the engine intake manifold, the engine may be transitioned to operating all eight cylinders. The desired engine volumetric efficiency and torque may be provided via partially closing the throttle and advancing or retarding spark timing. In this way, the engine may be operated at a lower volumetric efficiency to provide sonic velocity and/or flow between the engine intake manifold and fuel vapor storage canister. Method 400 proceeds to exit after engine operation is adjusted.

In still another example, operation of a device other than the engine may be adjusted to provide sonic velocity and/or mass flow from the fuel vapor storage canister to the engine intake manifold. For example, flow through venturi control valve 157 may be increased up to a level, but not exceeding the level, where sonic velocity and/or mass flow is provided between the engine air intake and the fuel vapor storage canister via venturi 173. Further, boost provided by compressor 162 may be increased to improve performance of venturi 173 so that sonic flow is achieved between the fuel vapor storage canister and the engine air intake. However, adjustment of the device is not further increased since little if any benefit may be provided by operating the device to attempt to provide additional flow. Method 400 proceeds to exit after 426.

Thus, the method of FIG. 4 provides for purging fuel vapors, comprising: supplying fuel vapors to an engine via a storage canister and a purge valve; and adjusting an engine valve timing up to and not exceeding a timing where a sonic flow occurs between the storage canister and the engine in response to a concentration of hydrocarbons flowing from the storage canister to the engine. In this way, the engine may be operated efficiently while purging fuel vapors.

In one example, the method includes where the sonic flow is achieved via reducing a pressure within an intake manifold of the engine. The method also includes where the pressure in the intake manifold is decreased via retarding intake valve closing time and at least partially closing a throttle. The method further comprises adjusting engine valve timing to provide less than sonic flow rate between the storage canister and the engine when the concentration of hydrocarbons flowing from the storage canister to the engine is less than a threshold. The method also includes where the purge valve is substantially fully open when the concentration of hydrocarbons flowing from the storage canister to the engine exceed a threshold at which time adjustment of the engine valve timing begins. The method further comprises estimating the concentration of hydrocarbons via a temperature of the storage canister.

In another example, the method of FIG. 4 provides for purging fuel vapors, comprising: supplying fuel vapors to an engine via a storage canister and a purge valve; and adjusting operation of a device to provide sonic velocity of a gas between the storage canister and the engine in response to a concentration of hydrocarbons in the storage canister, operation of the device adjusted up to but not exceeding where sonic flow is achieved between the storage canister and the engine. The method includes where the sonic flow is achieved via adjusting a flow rate through a venturi. In another example, the method includes where the sonic flow is achieved via adjusting engine valve timing.

In one example, the method includes where engine valve timing is retarded to retard intake valve closing time. The method also includes where the device is adjusted to increase flow between the storage canister and the engine from flow less than sonic flow up to sonic flow. In still another example, the method includes where the concentration of hydrocarbons in the canister is estimated via a hydrocarbon sensor in a canister vent line.

The method of FIG. 4 also provides for purging fuel vapors, comprising: operating an engine at a first volumetric efficiency at a first engine speed and torque output while purging fuel vapors stored in a canister to the engine in response to a first concentration of hydrocarbon vapors flowing from the canister to the engine; and operating the engine at a second volumetric efficiency at the first engine speed and torque output while purging fuel vapors stored in the canister to the engine in response to a second concentration of hydrocarbon vapors flowing from the canister to the engine. Thus, sonic velocity and/or mass flow between a fuel vapor storage canister and an engine intake manifold may be provided via adjusting engine volumetric efficiency.

In one example, the method includes where the first concentration of hydrocarbon vapors is a lower concentration of hydrocarbon vapors than the second concentration of hydrocarbon vapors, and where the first volumetric efficiency is higher than the second volumetric efficiency. The method also includes where the second volumetric efficiency is provided by adjusting an actuator of the engine. In some examples, the method includes where the actuator adjusts a phase of a cam relative to a crankshaft. The method also includes where the actuator adjusts a flow rate through a venturi.

In some examples, the method further comprises transitioning from operating the engine at the first volumetric efficiency to operating the engine at the second volumetric efficiency in response to the first concentration of hydrocarbons increasing after a predetermined amount of time has passed since opening a purge valve. The method includes where the predetermined amount of time is an amount of time to flow hydrocarbons from the canister to the engine at present operating conditions. The method further comprises where the first volumetric efficiency is reduced to the second volumetric efficiency in response to the first concentration of hydrocarbons increasing, and where the second volumetric efficiency is reduced only by an amount that provides sonic flow between a limiting restriction in a passage between the canister and the engine.

As will be appreciated by one of ordinary skill in the art, routines described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for purging fuel vapors, comprising:

supplying fuel vapors to an engine via a storage canister including activated carbon and a purge valve positioned between the engine and the storage canister; and limiting an engine intake valve timing to a timing not exceeding a timing where a sonic flow occurs between the storage canister and the engine in response to a concentration of hydrocarbons flowing from the storage canister to the engine.

2. The method of claim 1, where the sonic flow is achieved via reducing a pressure within an intake manifold of the engine.

3. The method of claim 2, where a pressure in the intake manifold is decreased via retarding intake valve closing time and at least partially closing a throttle.

4. The method of claim 1, further comprising adjusting engine intake valve timing to provide less than sonic flow rate between the storage canister and the engine when the concentration of hydrocarbons flowing from the storage canister to the engine is less than a threshold.

5. The method of claim 1, where the purge valve is substantially fully open when the concentration of hydrocarbons flowing from the storage canister to the engine exceeds a threshold at which time adjustment of the engine intake valve timing begins.

6. The method of claim 1, where the engine intake valve timing adjustment includes retarding IVC timing toward bottom-dead-center intake stroke.

7. A method for purging fuel vapors, comprising:

supplying fuel vapors to an engine via a storage canister including activated carbon and a purge valve positioned between the engine and the storage canister; and limiting operation of a device to provide a sonic velocity of a gas between the storage canister and the engine in response to a hydrocarbon concentration in the storage canister, operation of the device adjusted to not exceed where sonic velocity is achieved between the storage canister and the engine.

8. The method of claim 7, where the sonic velocity is achieved via adjusting a flow rate through a venturi.

9. The method of claim 7, where the sonic velocity is achieved via adjusting engine intake valve timing.

10. The method of claim 9, where engine intake valve timing is retarded to retard intake valve closing time.

11. The method of claim 7, where the device is adjusted to increase velocity of a gas between the storage canister and the engine from a velocity less than sonic flow up to sonic velocity.

12. The method of claim 7, where the hydrocarbon concentration in the canister is estimated via a hydrocarbon sensor in a canister vent line.

13. A method for purging fuel vapors, comprising:

operating an engine at a first volumetric efficiency at a first engine speed and torque output while purging fuel vapors stored in a canister including activated carbon to the engine in response to a first concentration of hydrocarbon vapors flowing from the canister including activated carbon to the engine; and operating the engine at a second volumetric efficiency at the first engine speed and torque output while purging fuel vapors stored in the canister including activated carbon to the engine in response to a second concentration of hydrocarbon vapors flowing from the canister including activated carbon to the engine.

14. The method of claim 13, where the first concentration of hydrocarbon vapors is a lower concentration of hydrocarbon vapors than the second concentration of hydrocarbon vapors, and where the first volumetric efficiency is higher than the second volumetric efficiency.

15. The method of claim 13, where the second volumetric efficiency is provided by adjusting an actuator of the engine.

16. The method of claim 15, where the actuator adjusts a phase of a cam relative to a crankshaft.

17. The method of claim 15, where the actuator adjusts a flow rate through a venturi.

18. The method of claim 13, further comprising transitioning from operating the engine at the first volumetric efficiency to operating the engine at the second volumetric efficiency in response to the first concentration of hydrocarbons increasing after a predetermined amount of time has passed since opening a purge valve.

19. The method of claim 18, where the predetermined amount of time is an amount of time to flow hydrocarbons from the canister to the engine at present operating conditions.

20. The method of claim 13, further comprising where the first volumetric efficiency is reduced to the second volumetric efficiency in response to the first concentration of hydrocarbons increasing, and where the second volumetric efficiency is reduced only by an amount that provides sonic flow between a limiting restriction in a passage between the canister and the engine.

* * * * *